United States Patent [19]

Thome

[11] 3,961,994

[45] June 8, 1976

[54] MANUFACTURE OF GRINDING MEMBERS OF FERROUS ALLOYS

[75] Inventor: Michel Thome, Paris, France

[73] Assignee: Acieries Thome Cromback, Paris, France

[22] Filed: May 3, 1974

[21] Appl. No.: 466,884

[30] Foreign Application Priority Data

May 4, 1973 France.....73.16163

[52] U.S. Cl...... 148/12 R; 148/12.4; 148/35; 148/138; 148/141

[51] Int. Cl.[2]..... C21D 7/14

[58] Field of Search..... 148/12 R, 12.4, 138, 148/141, 35

[56] References Cited

UNITED STATES PATENTS

| | | | |
|---|---|---|---|
| 2,773,761 | 12/1956 | Fuqua et al. | 148/12 R |
| 3,844,844 | 10/1974 | Sato | 148/12 R |

*Primary Examiner*—R. Dean

*Attorney, Agent, or Firm*—Haseltine, Lake & Waters

[57] ABSTRACT

Forged grinding members and a method for their manufacture from white cast iron having a high chromium content comprising heating a bar of white cast iron of 1.5% to 3% by weight carbon, 8 to 25% by weight chromium, 0% to 2% by weight molybdenum at a temperature of 1000° to 1120°C then forming pieces from the bar at the above temperature and thereafter forging these pieces at a second temperature of 1000° to 1070°C followed by hardening with optional intermediate isothermal treatment. The selection of the first and second temperatures depends on the chemical composition of the initial material and on the desired martensitic or austenitic micrographic structure of the desired product to obtain chromium carbides exclusively of the $M_7C_3$ type.

16 Claims, 4 Drawing Figures

MANUFACTURE OF GRINDING MEMBERS OF FERROUS ALLOYS

The invention relates to the manufacture of grinding members of ferrous alloys having a high chromium content, for example grinding balls.

In industries using grinding members, in particular the cement industry, balls made from white cast iron having a high chromium content are preferably used. It is known that the exceptional characteristics of resistance to abrasion and repeated impact of these grinding members are associated, on the one hand, with the composition of the metal and, on the other hand, with its micrographic structure, composed of a solid martensitic solution containing secondary carbides and a system of primary or eutectic carbides. It is also known that these characteristics will be all the better, the more numerous the primary carbides, the finer they are and the more homogeneously they are distributed.

In fact, it is known that wear results from eroding the matrix, which liberates the carbides, then exposes them or breaks them owing to their fragility; the wear is less the smaller and more numerous the regions constituting the matrix and the smaller and more numerous the carbides distributed in the matrix.

Thus, balls forged from white cast iron would have superior characteristics of resistance to abrasion to balls moulded from the same composition.

Nevertheless, in the present state of the art, grinding members forged from white cast iron having a high chromium content are hardly used, because their manufacture involves the casting of slugs, difficult rolling, forging and a heat treatment, which results in numerous technical difficulties and a prohibitive cost price.

Nevertheless, it has already been proposed, for example in French Pat. No. 2 174 969, to use forged grinding members having a relatively high chromium content (1 to 2% by weight), or white cast irons having a low chromium content and a low nickel content. These cast irons comprise a solid solution, which may be either martensitic, or martensitic and perlitic, or at least perlitic. They always comprise solely finely dispersed carbides of the cementite type, having a general formula of $M_3C$, where M designates the metal in question, which has a double drawback.

On the one hand, these carbides only give white cast irons a very limited resistance to abrasion, since their hardness does not exceed 53 Rockwell, i.e. approximately 530 Brinell;

On the other hand, the quantity of auxiliary metal used (Cr, Ni) is considerable, which substantially increases the cost of the cast iron obtained.

It is an object of an invention to eliminate an difficulties of the known art and to remedy the above mentioned drawbacks.

Consequently, the invention contemplates a simple and inexpensive manufacturing method and, in any case, one which is less troublesome than known methods for manufacturing forged grinding members from white cast iron having a high chromium content.

The invention also contemplates the grinding members having a high resistance to abrasion, obtained by this method.

The method according to the invention is thus a method for the manufacture of forged grinding members of white cast iron having a high chromium content, the structure of which is composed of a solid martensitic or austenitic solution containing secondary chromium carbides and primary or eutectic chromium carbides of the finely divided type $M_7C_3$ distributed in a homogeneous manner, characterized in that the initial material used consists of a bar of white cast iron containing from 1.5% to 3% by weight carbon, from 8 to 25% by weight chromium, from 0 to 2% by weight molybdenum and optional special substances such as vanadium, tungsten, boron, nickel, copper and in that the said bar or pieces coming from this bar are heated at a first desired temperature, in that the said bar is possibly cut into pieces at this first temperature and in that pieces forged forges at a second temperature, said first and second temperatures being chosen depending on the chemical composition of the initial material, on the martensitic or austenitic micrograhic structure of the balls which it is desired to obtain and on the manufacturing conditions, with a view to obtaining chromium carbides exclusively of the $M_7C_3$ type.

Preferably, for reasons which will be given hereafter, the initial metal used in the manufacturing method according to the invention is in the form of bars obtained by continuous casting. The bars may be obtained directly at the desired diameter or obtained by continuous casting followed by working.

The bars of this metal are heated at a first desired temperature, cut into pieces at this temperature and these pieces are forged at a second desired temperature, said first and second temperatures depending on the chemical composition of the metal, on the desired micrographic structure of the ball (martensite or austenite) and the manufacturing conditions.

The forging is possibly followed by a heat treatment, comprising isothermal preservation at a desired temperature, immediately after the forging and hardening in air or oil.

The heat treatment according to the invention may possibly be followed by tempering at a temperature less than the initial temperature for transformation from martensite to perlite, for example tempering at 200° – 250°C, or tempering at 450° – 550°C, according to the carbon and chromium content.

The balls thus obtained have a structure composed of a martensitic or austenitic solid solution, containing only chromium carbides of the type $M_7C_3$, with the exclusion of iron or cementite carbides of the type $M_3C$. The hardness of $Cr_7C_3$ carbides is much greater than that of cementite, since it is of approximately 1400 Vickers and the balls according to the invention thus have a remarkable resistance to abrasion.

It has been noted that for certain applications such as, for example, the grinding of steel and cast iron shot, which requires the use of balls having a diameter greater than 120mm, it is economically more advantageous to use balls according to the invention, having a completely austenitic structure, than balls according to the invention having a martensitic structure. In fact, it has been noted that a cast ball having a diameter greater than 90mm, for example 120mm and a composition of 15% chromium and 0.2% molybdenum, treated by annealing and hardening, has a mixed martensite - perlite structure having only slight resistance to wear.

A ball of 120mm of the same analysis, obtained by forging followed by isothermal treatment and hardening, does not have a complete martensitic structure, even on the surface, owing to the lack of hardenability; thus, slight resistance to wear will be obtained.

A good result could be obtained by increasing the percentage of molybdenum from 0.2% to 1%, i.e. with a clear increase in the cost of the ball.

Due to the choice of temperature for heating the bar, before shearing and forging, the invention proposes to obtain a stable austenitic structure which will not be followed by an isothermal treatment.

Indeed, the sole fact of achieving a minimum temperature threshold makes it possible to obtain a stable austenite at ambient temperature, an austenite which will be transformed by simple cold hammering or impact, due to its specific use, into martensite which resists wear perfectly.

It has also been noted that the forging conditions, in particular the temperatures at which the bars are reheated, may influence the conditions of heat treatment after forging.

The detailed descriptions given hereafter as examples will show clearly the manufacturing method according to the invention. They are in no way limiting.

Example 1

This example relates to the manufacture of balls having a diameter of 120mm from bars having a diameter of approximately 90mm, obtained by continuous casting, the chemical composition of which is approximately as follows:

carbon . . . 2.2% by weight
chromium . . . 14% by weight
molybdenum . . . 0% by weight
silicon . . . 0.7% by weight
manganese . . . 0.8% by weight.

The conditions of the manufacturing method are as follows:

re-heating of the bars takes place at a temperature of between 1100°C and 1120°C (temperature for obtaining stable austenite);
the bars are cut into pieces at this temperature;
the pieces are forged to form balls at a temperature of between 1050°C and 1070°C;
the balls are immediately hardened in blown air.

The micrographic structure of these balls is thus composed of a completely austenitic solid solution, containing secondary carbides and finely divided eutectic carbides distributed in a homogeneous manner. The Brinell hardness is approximately 400.

Example 2

This example relates to the manufacture of balls having a diameter of 90mm from bars having a diameter of approximately 65mm, obtained by continuous casting, the chemical composition of which is as follows:

carbon . . . 2.20% by weight
chromium . . . 14.2% by weight
molybdenum . . . 0.28% by weight
silicon . . . 0.72% by weight
manganese . . . 0.88% by weight The conditions of the manufacturing process are as follows:

re-heating of the bars takes place at a temperature of between 1070°C and 1100°C, corresponding to a partially stabilized austenite, allowing easy forging in economical conditions;
the bars are cut into pieces at this temperature;
the pieces are forged to form balls at a temperature of between 1020°C and 1050°C;

the balls are then subjected to a heat treatment composed of isothermal treatment which ensures the return to a completely unstable austenite, directly after forging, for a period of 15 minutes, at a temperature of between 970°C and 990°C, then hardening in blown air and tempering at a temperature of 250°C.

The micrographic structure of the balls is composed of a martensitic solid solution, containing secondary carbides and finely divided eutectic carbides distributed in a homogeneous manner. The Brinell hardness is 620 at the minimum.

It should be noted that a conventional treatment, composed of annealing and hardening, would make it possible to recover balls which were inadequately treated in said isothermal treatment or even to replace the latter, but clearly with an increase in the cost price.

If the diameter of the ball increases, whether the latter is moulded or forged, under identical treatment conditions and with an identical composition, the structure obtained will be a martensite - perlite mixture, having only slight resistance to wear.

Example 3

We will now consider the manufacture of balls having a diameter of 50mm from bars of approximately 45mm, obtained by continuous casting, the chemical composition of which is approximately as follows:

carbon . . . 2.2% by weight
chromium . . . 14% by weight
molybdenum . . . 0.25% by weight
silicon . . . 0.7% by weight
manganese . . . 0.8% by weight.

The conditions of the manufacturing method are as follows:

the re-heating of the bars takes place at a temperature of between 1000°C and 1020°C, corresponding to a de-stabilized proportion of austenite of approximately 100%.
the bars are cut into pieces at this temperature and immediately forged;
the balls are then immediately subjected to hardening in blown air and to tempering at 250°C;
the micrographic structure is composed of a martensitic solid solution containing secondary carbides and finely divided eutectic carbides distributed in a homogeneous manner. The Brinell hardness is greater than 620.

One important feature of the balls according to the invention resides in their micrographic structures. The latter are shown clearly in the attached photographs, given as a non-limiting example and in which.

Figure 1:
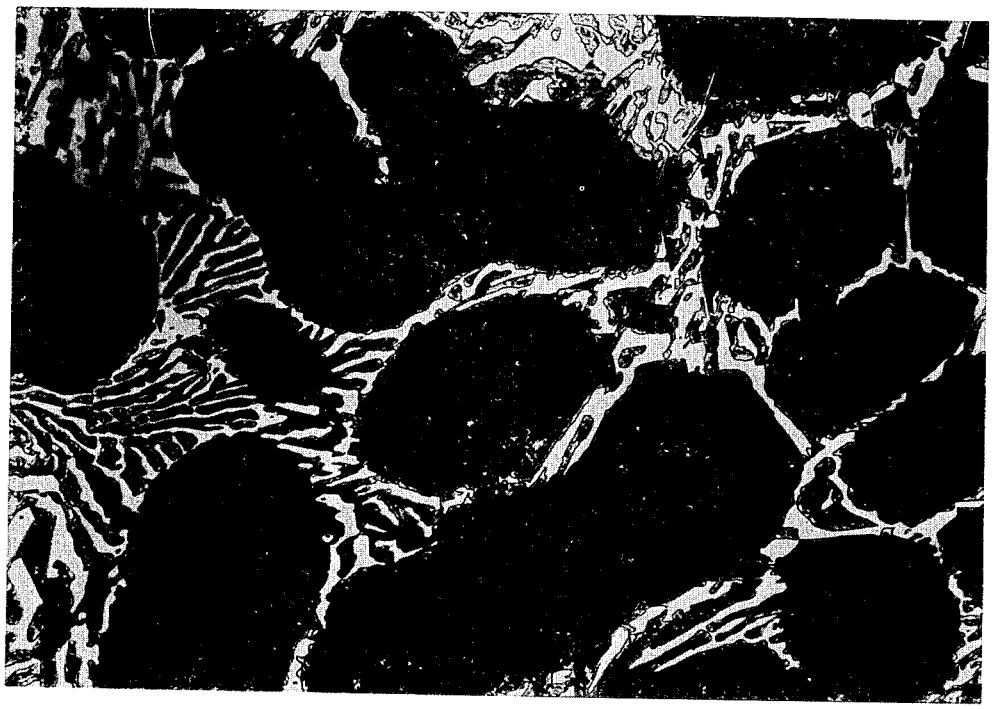
FIGS. 1 and 2 are micrographs, respectively of a moulded ball of conventional type and of a forged ball according to the invention.
Figure 2:
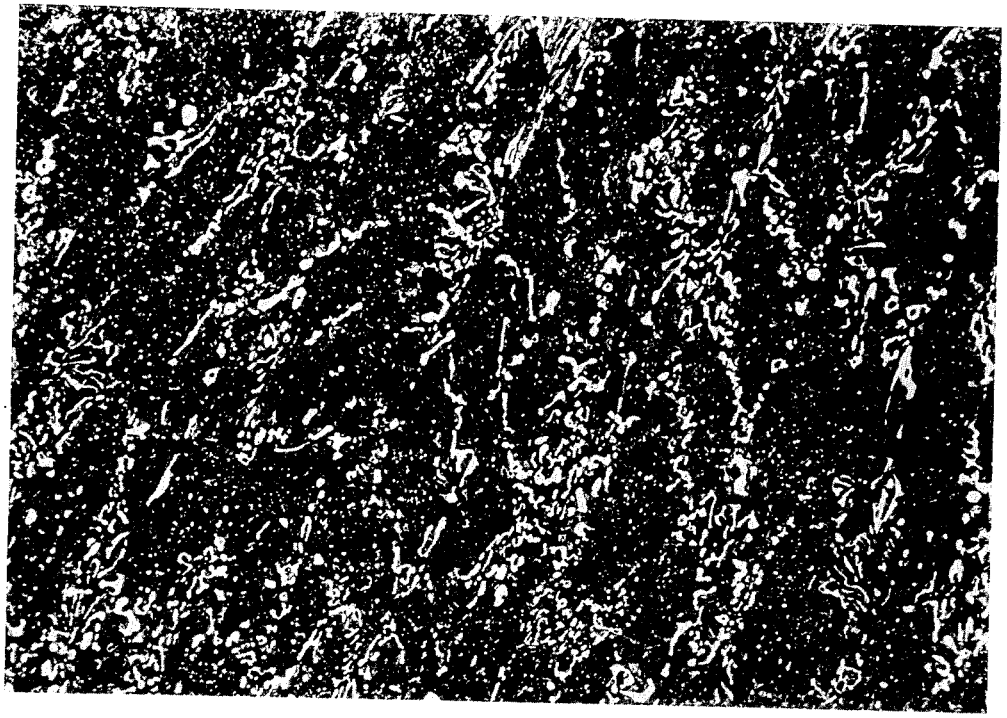

The micrographs of FIGS. 1 and 2, the magnification of which is 600, respectively show the types of structure, after heat treatment, of a moulded ball having a diameter of 90mm and a forged ball of the same diameter according to the invention, whereof the chemical compositions, which are substantially identical, are as follows:

| | Moulded ball (% by weight) | Forged ball (% by weight) |
|---|---|---|
| Carbon | 2.17 | 2.16 |
| Chromium | 15.02 | 14.75 |
| Molybdenum | 0.26 | 0.23 |
| Silicon | 0.93 | 1.08 |
| Manganese | 1.27 | 1.27 |

In the moulded balls (FIG. 1), the structure is composed of a solid martensitic solution, containing secondary carbides precipitated during annealing and a very considerable system of eutectic carbides, dividing the matrix into regions.

In the forged balls according to the invention (FIG. 2), the structure is composed of a solid martensitic solution, containing secondary carbides and finely divided eutectic carbides distributed in a homogeneous manner.

One important feature of the forged balls according to the invention resides in the homogeneous division and distribution of the primary carbides of the $M_7C_3$ type, which are the consequences, on the one hand, of the micrographic structure of the bar obtained by continuous casting and, on the other hand, of forging.

Figure 3:
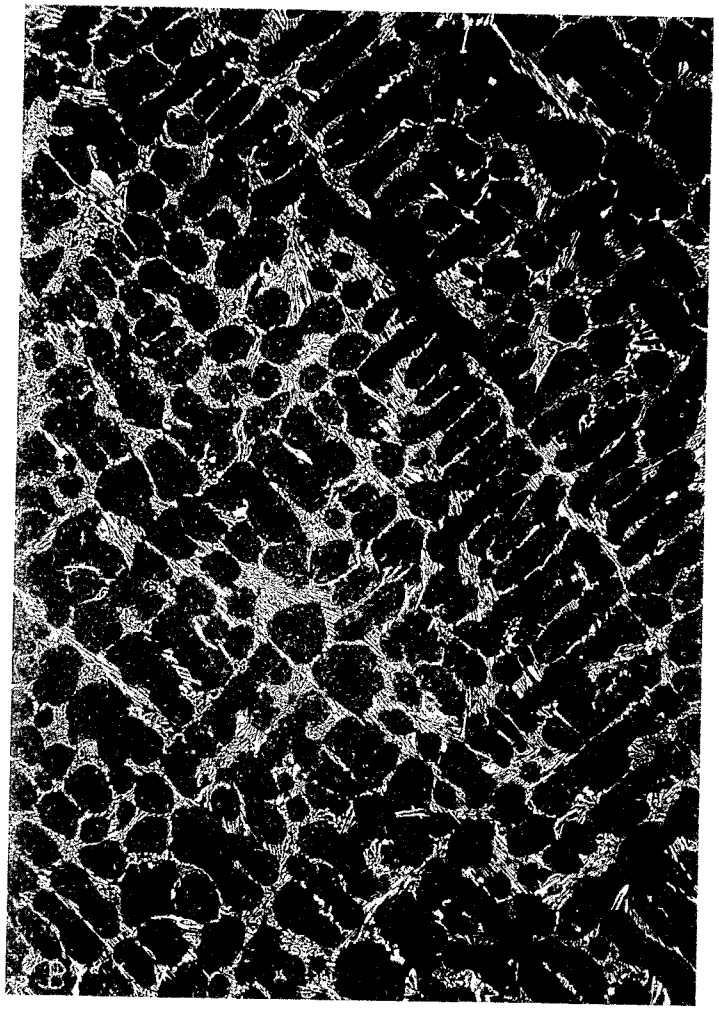
FIGS. 3 and 4 are respectively micrographs of a bar obtained by continuous casting and of a moulded slug, which may be used as the initial material.
Figure 4:
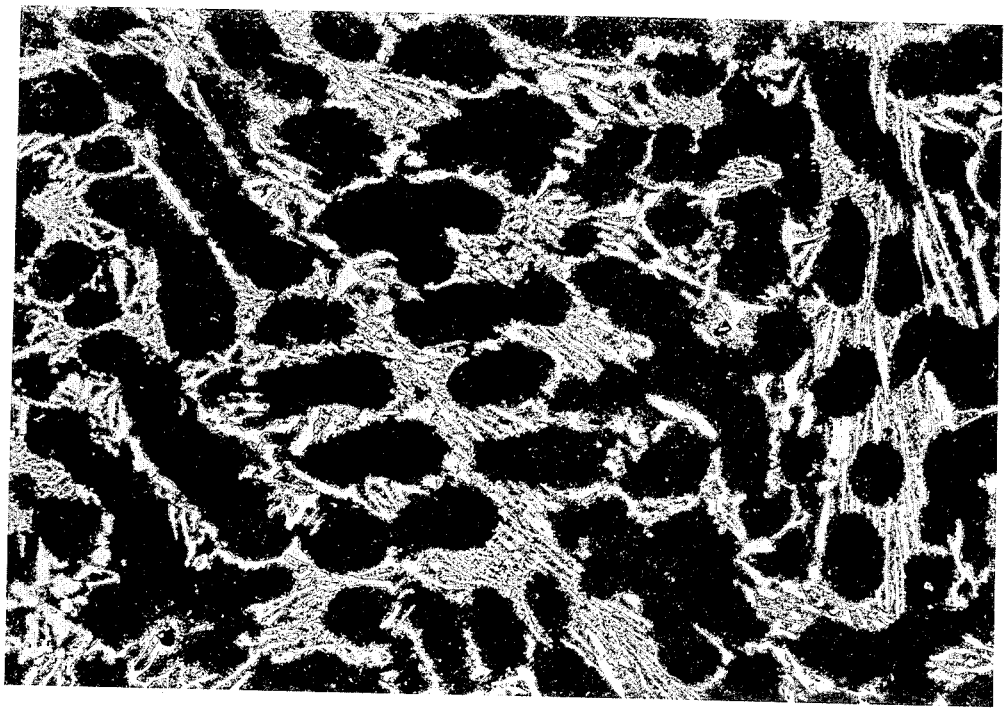

The micrographs of FIGS. 3 and 4, having a magnification of 250, show the structures, after heat treatments, of a bar having a mean diameter of 59mm, obtained by continuous casting and of a slug moulded in sand, having a mean diameter of 60mm, the chemical compositions of which are approximately:

carbon . . . 2.0% by weight
chromium . . . 15.0% by weight
molybdenum . . . 0% by weight
silicon . . . 0.8% by weight
manganese . . . 1.0% by weight.

This bar or this slug may be used as initial material for carrying out the method according to the invention.

In both cases, the micrographic structure is composed of a solid martensitic solution, containing secondary carbides and of a considerable system of eutectic carbides, dividing the matrix into regions. The system of carbides is nevertheless more compact and the carbides are less solid in the bar obtained by continuous casting than in the slug of the same diameter. This difference is due to a lower casting temperature and to a higher solidification speed in continuous casting than in conventional casting.

During forging, which mechanically breaks up the solid carbides and small rounded masses, the distribution of the carbides becomes more homogeneous and their dimensions finer the denser and finer the initial system of primary carbides. The initial structure may be obtained by continuous casting or any other method having a high solidification speed, for example chill moulding.

It is not possible to accurately calculate the exact content of primary and secondary carbides in the balls. Indeed, in moulded balls, the system of primary carbides is practically continuous, such that it is difficult to define the mean dimension of the carbides, whereas in balls forged according to the invention, it is very difficult to distinguish and count the primary carbides divided during forging and the small secondary carbides precipitated during the heat treatments, owing to their very small dimensions.

Taking into account the chromium content of the grinding members according to the invention, the primary carbides as well as the secondary carbides of these grinding members are of the $M_7C_3$ type, as is clearly apparent from the ternary diagrams Fe-Cr-C, which are well known in the art.

The content of primary carbides, the density of these carbides per $mm^2$ and their mean dimensions have nevertheless been evaluated by the Applicant. The Applicant's observations show that the primary carbide content is practically the same for moulded balls and forged balls. In the case of the examples illustrated in the micrographs of FIGS. 1 and 2, this content is of the order of 17.5% by weight, the complement, or 82.5%, constituting the matrix.

On the other hand, the number of primary carbides is very different when comparing moulded balls and forged balls. Indeed, in the first case, (moulded balls), if we compare the system of primary carbides to a pile of carbides, the number of primary carbides per square millimeter is of the order of 5,000. On the contrary, in the case of forged balls according to the invention, even when ignoring small primary carbides divided during forging and secondary carbides which cannot even be distinguished, the number of carbides of sufficient size to be counted (maximum dimension greater than or equal to one micron, is at least 17,000/$mm^2$.

Similarly, the mean dimensions of carbides (evaluated on the surface in the micrographs) are very different, since they vary from approximately $35\mu^2$ for moulded balls to approximately $10\mu^2$ of balls forged according to the invention.

It will thus be noted that the method according to the invention makes it possible to obtain forged balls from white cast iron having a high chromium content, containing a very large number of carbides of small dimension in the matrix and consequently having great resistance to wear.

I claim:

1. A method for the manufacture of forged grinding members from white cast iron having a high chromium content, the structure of which is composed of a solid martensitic or austenitic solution containing secondary chromium carbides and primary or eutectic chromium carbides of the $M_7C_3$ type, which are finely divided and distributed in a homogeneous manner, said method comprising heating at a temperature of 1000° to 1120°C a bar of white cast iron consisting essentially of 1.5% to 3% weight carbon, 8 to 25% by weight chromium, 0 to 2% by weight molybdenum and the remainder iron, cutting said bar into pieces at said temperature, forging said pieces at a second temperature of 1000° to 1070°C and hardening the forged pieces to obtain a solid martensitic or austentic solution containing chromium carbides exclusively of the $M_7C_3$ type and with exclusion of cementite carbides of $M_3C$ type.

2. A method according to claim 1 wherein the initial cast iron consists of 2.2% by weight carbon, 14% by weight chromium, 0.1 to 0.3% by weight molybdenum, 0.7% by weight silicon and 0.8% by weight manganese.

3. A method according to claim 1 wherein said hardening is effected in air to provide the grinding members with a Brinell hardness of approximately 400 and a structure composed of solid austenitic solution containing primary or eutectic chromium carbides exclusively of the $M_7C_3$ type, which are finely divided and distributed in a homogeneous manner.

4. A method according to claim 1 wherein the bar is heated at a temperature of 1070°C to 1100°C and the pieces are forged at a temperature of 1020°C, the forging being immediately followed by isothermal treatment for 15 minutes at 970°C to 990°C, the hardening being effected thereafter in air or oil, to provide the grinding members with a Brinell hardness greater than 620 and a structure composed of a solid martensitic solution containing secondary chromium carbides and primary or eutectic chromium carbides exclusively of the $M_7C_3$ type, which are finely divided and distributed in homogeneous manner.

5. A method according to claim 1 wherein the bar is heated and the pieces are forged at a temperature of 1000°C to 1020°C, the hardening being effected in air or oil to provide the grinding members with a Brinell hardness greater than 620 and a structure composed of a solid martensitic solution containing secondary chromium carbides and primary or eutectic chromium carbides exclusively of the $M_7C_3$ type, which are finely divided and distributed in a homogeneous manner.

6. A method according to claim 1 comprising effecting a thermal treatment after said hardening consisting of tempering at a temperature less than that of the beginning of transforming martensite into perlite.

7. A method according to claim 4 comprising effecting annealing after the isothermal treatment and before the hardening in air or oil.

8. A method for the manufacture of forged grinding members, balls, cylinders, bars and workpieces, made from white cast iron having a high chromium content, the structure of which is composed of a martensitic or austenitic solution containing secondary chromium carbides and primary or eutectic chromium carbides of the $M_7C_3$ type, which are finely divided and distributed in a homogeneous manner, said method comprising heating pieces divided from a bar of white cast iron consisting essentially of 1.5% to 3% by weight carbon, 8 to 25% by weight chromium and 0–2% by weight molybdenum and the remainder iron at a first temperature of 1000°–1120° forging said pieces at a second temperature of 1000° to 1070°C and hardening the forged pieces to obtain a solid martensitic or austentic solution containing chromium carbides exclusively of the $M_7C_3$ type and with exclusion of cementite carbides of $M_3C$ type.

9. A method according to claim 8 wherein the initial cast iron consists of 2.2% by weight carbon, 14% by weight chromium, 0.1 to 0.3% by weight molybdenum, 0.7% by weight silicon and 0.8% by weight manganese.

10. A method according to claim 8 wherein said hardening is effected in air to provide the grinding members with a Brinell hardness of approximately 400 and a structure composed of a solid austenitic solution containing primary or eutectic chromium carbides exclusively of the $M_7C_3$ type which are finely divided and distributed in a homogeneous manner.

11. A method according to claim 8 wherein the bar is heated at a temperature of 1070°C to 1100°C and the pieces are forged at a temperature of 1020°C, the forging being immediately followed by isothermal treatment for 15 minutes at 970°C to 990°C, the hardening being effected thereafter in air or oil to provide the grinding members with a Brinell hardness greater than 620 and a structure composed of a solid martensitic solution containing secondary chromium carbides and primary or eutectic chromium carbides exclusively of the $M_7C_3$ type, which are finely divided and distributed in a homogeneous manner.

12. A method according to claim 8 wherein the bar is heated and the pieces are forged at a temperature of 1000°C to 1020°C, the hardening being effected in air or oil to provide the grinding members with a Brinell hardness greater than 620, and a structure composed of a solid martensitic solution containing secondary chromium carbides and primary or eutectic chromium carbides exclusively of the $M_7C_3$ type, which are finely divided and distributed in a homogeneous manner.

13. A method according to claim 8 comprising effecting a thermal treatment after said hardening consisting of tempering at a temperature less than that of the beginning of transforming martensite into perlite.

14. A method according to claim 11 comprising effecting annealing after the isothermal treatment and before the hardening in air or oil.

15. As new industrial products, forged grinding members made from white cast iron having a high chromium content, consisting essentially of 1.5 to 3% by weight carbon, 8 to 25% by weight chromium, 0 to 2% by weight molybdenum and the remainder iron and having a structure composed of a solid martensitic or austenitic solution containing secondary chromium carbides and primary or eutectic chromium carbides exclusively of the $M_7C_3$ type and with exclusion of cementite carbides of $M_3C$ type, said carbides being finely divided and distributed in a homogeneous manner.

16. Grinding members according to claim 15 wherein the chromium carbide content is at least 17,000/mm$^2$.

* * * * *